US007255177B2

(12) United States Patent
Duggan et al.

(10) Patent No.: US 7,255,177 B2
(45) Date of Patent: Aug. 14, 2007

(54) TUBING EXPANSION

(75) Inventors: Andrew Michael Duggan, Westhill (GB); Simon John Harrall, Houston, TX (US); Paul David Metcalfe, Aberdeen (GB); David John Hillis, Balmedie (GB); Wayne Rudd, Newcastle Upon Tyne (GB)

(73) Assignee: Weatherford/Lamb, Inc., Houston, TX (US)

( * ) Notice: Subject to any disclaimer, the term of this patent is extended or adjusted under 35 U.S.C. 154(b) by 251 days.

(21) Appl. No.: 10/869,458

(22) Filed: Jun. 16, 2004

(65) Prior Publication Data

US 2005/0161226 A1 Jul. 28, 2005

(30) Foreign Application Priority Data

Jun. 16, 2003 (GB) ..... 0313891.4
Nov. 15, 2003 (GB) ..... 0326670.7

(51) Int. Cl.
*E21B 23/02* (2006.01)

(52) U.S. Cl. ..... 166/380; 166/384; 166/207

(58) Field of Classification Search ..... None
See application file for complete search history.

(56) References Cited

U.S. PATENT DOCUMENTS

| | | | | |
|---|---|---|---|---|
| 3,191,677 | A | 6/1965 | Kinley | |
| 3,203,483 | A | 8/1965 | Vincent | |
| 3,353,599 | A | 11/1967 | Swift | |
| 5,957,195 | A | 9/1999 | Bailey et al. | |
| 6,112,818 | A * | 9/2000 | Campbell | 166/384 |
| 6,550,539 | B2 * | 4/2003 | Maguire et al. | 166/380 |
| 6,575,240 | B1 | 6/2003 | Cook et al. | |
| 6,662,876 | B2 * | 12/2003 | Lauritzen | 166/380 |
| 6,688,397 | B2 * | 2/2004 | McClurkin et al. | 166/380 |
| 6,712,151 | B2 * | 3/2004 | Simpson et al. | 166/384 |
| 7,066,259 | B2 * | 6/2006 | Duggan et al. | 166/277 |
| 2004/0149442 | A1 | 8/2004 | MacKenzie | |
| 2004/0182569 | A1 | 9/2004 | Cook et al. | |
| 2005/0056433 | A1 | 3/2005 | Ring et al. | |
| 2005/0126251 | A1 | 6/2005 | Oosterling et al. | |
| 2005/0217866 | A1 | 10/2005 | Watson et al. | |
| 2005/0279509 | A1 | 12/2005 | Benzle et al. | |

FOREIGN PATENT DOCUMENTS

CA 2453400 1/2003

(Continued)

OTHER PUBLICATIONS

U.K. Search Report, Application No. GB 0413402.9, dated Sep. 16, 2004.

(Continued)

*Primary Examiner*—Frank Tsay
(74) *Attorney, Agent, or Firm*—Patterson & Sheridan, L.L.P.

(57) ABSTRACT

There are disclosed methods and apparatus for expanding downhole tubing.

In one embodiment, there is disclosed a method of expanding tubing comprising providing an assembly 40 comprising a section of expandable tubing (42) and an expansion device in the form of an expansion mandrel (44) located at least partially externally of the tubing (42), running the assembly (40) into a bore, translating the expansion mandrel (44) relative to the tubing (42) to expand an end section of the tubing (42), and further translating the expansion mandrel (44) relative to the tubing (42) to expand a further section of the tubing (42).

71 Claims, 16 Drawing Sheets

FOREIGN PATENT DOCUMENTS

| | | |
|---|---|---|
| GB | 2 374 101 | 10/2002 |
| WO | WO 01/18354 | 3/2001 |
| WO | WO 01/98623 | 12/2001 |
| WO | WO 03/006788 | 1/2003 |
| WO | WO 03/036018 | 5/2003 |
| WO | WO 03/078790 | 9/2003 |

OTHER PUBLICATIONS

GB Search Report dated Feb. 10, 2004 from GB Application No. 0326670.7.

GB Search Report dated Nov. 14, 2003 from GB Application No. 0313891.4.

Office Action dated May 23, 2006, from Canadian Intellectual Property Office, Canadian Patent Application No. 2,471,051.

* cited by examiner

TUBING EXPANSION

CROSS-REFERENCE TO RELATED APPLICATIONS

This application claims benefit of Great Britain patent application serial number GB 0313891.4, filed Jun. 16, 2003, and Great Britain patent application serial number GB 0326670.7, filed Nov. 15, 2003, which are herein incorporated by reference.

BACKGROUND OF THE INVENTION

1. Field of the Invention

The invention relates to tubing expansion. In particular, the invention relates to methods and apparatus for expanding tubing downhole.

2. Description of the Related Art

A significant recent development in the oil and gas exploration and production industry has been the introduction of expandable bore-lining tubing, that is tubing which may be run into a drilled bore and then expanded to a larger diameter. The tubing may take any appropriate form, including but not limited to casing, liner or sandscreen. Various methods have been proposed for expanding the tubing downhole, including the use of expansion cones or mandrels that are pushed or pulled through the tubing mechanically and\or fluid pressure driven. Alternatively, a rotary expander may be utilised, that is, a device including a number of rollers, each roller with an axis of rotation generally parallel to the tubing axis. The expander is rotated within the tubing with the rollers in rolling contact with the tubing inner surface. The rollers may define a fixed diameter, or may be mounted to permit radial movement.

Each expansion device has its own advantages and disadvantages. One disadvantage of using a fluid-driven expansion cone is that the cone, which of course describes a diameter larger than the tubing to be expanded, must be initially accommodated within a larger diameter section of the tubing, which those of skill in the art sometimes refer to as a "garage" or "launcher". This launcher is provided at the lower end of the tubing, and the end of the launcher, beyond the cone, may be selectively sealed and then pressured-up to push the cone upwardly through the tubing. Of course, this larger diameter tubing section limits the dimensions of the minimum diameter restriction that the assembly, including the remainder of the smaller diameter tubing, may pass through while being run into the bore. To minimise this limiting effect, the wall thickness of the launcher may be thinner than the wall thickness of the tubing to be expanded. However, this reduces the strength of the tubing which forms the launcher, such that the launcher may be more susceptible to damage as the tubing is run into the bore, which would interfere with the ability to launch the cone. Furthermore, having a relatively thin wall reduces the ability of the launcher to withstand the elevated pressures which are required to drive the cone through the tubing.

It is among the objectives of embodiments of the present invention to obviate or mitigate these difficulties.

SUMMARY OF THE INVENTION

According to the present invention there is provided a method of expanding tubing, the method comprising:

running expandable tubing into a bore together with an expansion device, with the expansion device located at least partially externally of the tubing; and translating the expansion device through at least part of the tubing to diametrically expand the tubing.

The invention also relates to a tubing assembly comprising a section of expandable tubing and an expansion device located at least partially externally of the tubing.

Locating the expansion device at least partially externally of the tubing avoids or minimises the requirement to provide a larger diameter portion of tubing to accommodate the device. If desired, a smaller diameter portion of the expansion device may be located within the tubing, or the device may be located wholly externally of the tubing. The external diameter described by the assembly is thus less than a conventional assembly, in which the expansion device is surrounded by tubing and the diameter described by the assembly is at least the diameter of the expansion device plus twice the wall thickness of the surrounding tubing.

The expansion device may take any appropriate form, and may be a cone or mandrel having a surface adapted to slide relative to the tubing surface. Alternatively, the expansion surface may be defined by rollers or other members that provide a rolling contact with the tubing surface. In other embodiments, a rotary expansion device may be provided, that is a device having one or more rolling elements for contact with the tubing, and which device is rotated about a longitudinal axis as the device is translated through the tubing.

The expansion device may be pulled or pushed through the tubing. The force necessary to translate the expansion device through the tubing may be applied mechanically, for example, via a string of drill pipe, or using a tractor, or fluid pressure may be utilised to drive the device through the tubing. Such fluid pressure may also be utilised to assist in the expansion of the tubing. In certain embodiments a combination of mechanical and fluid pressure force may be utilised.

The expansion device preferably has a fixed diameter. Alternatively, the expansion device may have a variable diameter, such than the device may be run into the bore in a retracted configuration and subsequently expanded to a larger diameter expansion configuration.

In another aspect of the present invention the expansion device is located at least partially within the tubing, and the portion of the tubing containing the device has a relatively thin wall.

The thin-walled portion of the tubing may serve to protect and at least partially accommodate the expansion device, although by virtue of the thinner wall the outer diameter of the portion will be less than in a conventional arrangement.

The provision of a relatively thin-wall portion may be achieved in a variety of ways. The thin-walled portion may be formed of the same material as the remainder of the tubing, with the result that the thin-walled portion is relatively weak. Alternatively, the thin-walled portion may be formed of a higher strength material, to maintain the strength of the tubing wall. In other embodiments the reduction in wall thickness may be achieved by, for example, omitting an elastomer sleeve, or filter screens, which are provided over the remainder of the tubing.

In other embodiments of the invention, said portion may take the form of a separate sleeve, shoe or the like which accommodates and protects the expansion device. This serves to protect the expansion device from damage as the tubing and the expansion device are run into the bore, and also prevents foreign material being pulled into the tubing with the expansion device when expansion of the tubing commences. Said portion may be adapted to separate from the expansion device on movement of the device into the tubing, or may be frangible or deformable such as not to interfere with subsequent operations.

Preferred embodiments of the invention relate to methods and apparatus utilising fluid driven expansion devices. Such devices may utilise a driving or translation means, such as a piston or jack arrangement, coupled to the expansion device such that supply of elevated pressure to the driving means applies a translating force to the expansion device. The driving means may be located internally of the tubing to be expanded. In the most preferred embodiment the expansion device will be located at or beyond the lower end of the tubing and the driving means will be coupled to the tubing and preferably located within the tubing, above the expansion device.

A single driving means may be utilised to provide the translation of the expansion device necessary to complete the expansion operation, but it is preferred that the driving means provides only an initial translation, thus serving as a first translation arrangement, which is preferably sufficient to locate the expansion device within the tubing. A second translation arrangement may then be utilised to drive the expansion device through the tubing. In a preferred embodiment, the initial translation of the expansion device is such to allow isolation of a section of expanded tubing behind the expansion device such that said isolated section of tubing may then be pressurised to drive the expansion device through the tubing.

In other embodiments the driving means or first translation arrangement may be actuated by any appropriate means, for example by application of tension, weight or torsion, which forces may be applied from surface or from a downhole tool or device such as a tractor or motor. As the driving means will generally only be required to provide an initial degree of expansion, over a relatively short length of tubing, the initial expansion may take place relatively slowly without impacting adversely on the overall operation timescale. Thus, the driving means need not produce rapid expansion, and thus may utilise, for example, a relatively high speed low torque input from an electric motor or turbine which is transferred through suitable gearing or a screw arrangement to provide a relatively low speed high torque/force output sufficient to drive the expansion device through the tubing and provide an initial expansion of the tubing.

Preferably, a second translation means is provided for translating the expansion device through the tubing to expand the tubing. Most preferably, the second translation means is operable to translate the expansion device and to expand the tubing following the initial translation and expansion provided by the drive means means or first translation means. The second translation means may include first or leading seal means for coupling to the expansion device such that a differential pressure across the seal means will tend to drive the device through the tubing. Most preferably, the seal means is provided ahead of the expansion device, and may be arranged to form a seal with an inner wall of the tubing. Alternatively, the seal means may be provided on a surface of the expansion device, or may be provided behind the device.

Preferably, the second translation means includes a further or trailing seal means to seal the tubing behind first seal means, such that elevated pressure utilised to drive the expansion device through the tubing is isolated from the bore. Most preferably, the further seal means is adapted to form a seal with the tubing, typically with an inner wall of the tubing. The further seal means may be adapted to be coupled or anchored to the tubing. Thus, the further seal means may be provided in the form of a packer arrangement. Alternatively, or in addition, the further seal means may define a profile adapted to engage a portion of the tubing, and most preferably an end of the tubing. The seal means may also serve to expand the end of the tubing. Following expansion, the free end of the tubing will tend to contract to a greater degree than the adjacent tubing, creating a profile which may serve to engage the seal means. Alternatively, or in addition, the further seal means may be provided in combination with other anchoring arrangements, such as slips or ratchet teeth. The further seal means may be releasable from the tubing. Alternatively, or in addition, the further seal means may be drillable, such that the further seal means may subsequently be milled or drilled out of the tubing.

The further seal means may be coupled to the expansion device such that the seal means is adapted to be pulled into the tubing as the expansion device is advanced into the tubing. The further seal means may be releasable from the expansion device following engagement of the tubing by the seal means.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
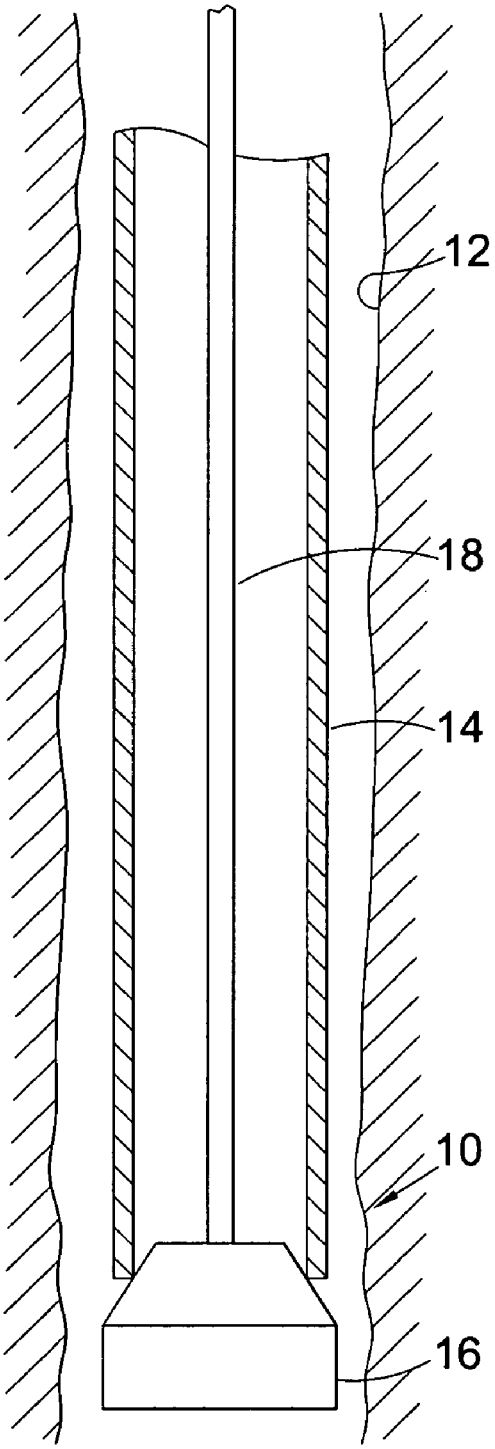
FIG. 1 is a schematic sectional view of a tubing assembly being run into a drilled bore, in accordance with a first embodiment of one aspect of the present invention.

Reference is first made to FIG. 1 of the drawings, which shows a tubing assembly 10 in accordance with a first embodiment of the present invention. The assembly 10, shown located in a drilled bore 12, comprises a length of expandable tubing 14 and an expansion cone 16 mounted to the lower end of a support string 18. The string 18 extends through the tubing 14 and up to the surface. The cone 16 is initially located at the lower end of the tubing 14, with only the tapered leading end of the cone 16 extending into the tubing 14: the portion of the cone 16 which describes a larger diameter than the unexpanded tubing 14 is located beyond the end of the tubing 14. Thus, in this example, the largest diameter described by the assembly corresponds to the maximum diameter of the cone 16.

Figure 2:
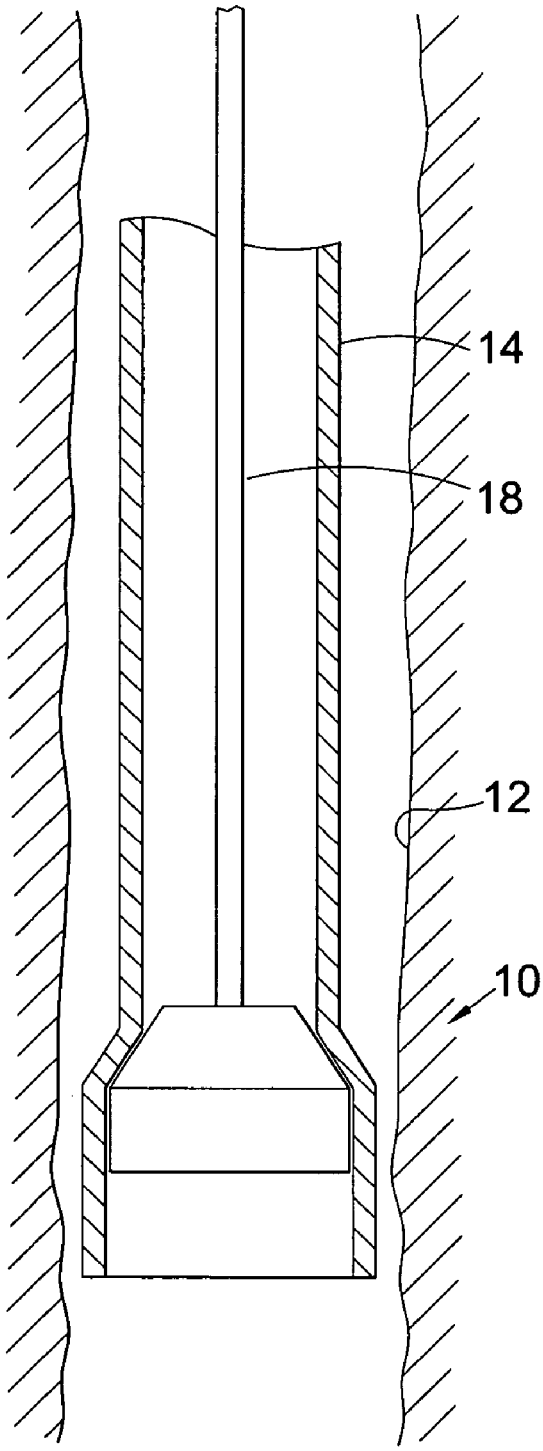
FIG. 2 is a schematic sectional view of a tubing assembly of FIG. 1, following commencement of expansion of the tubing.
Figure 3:
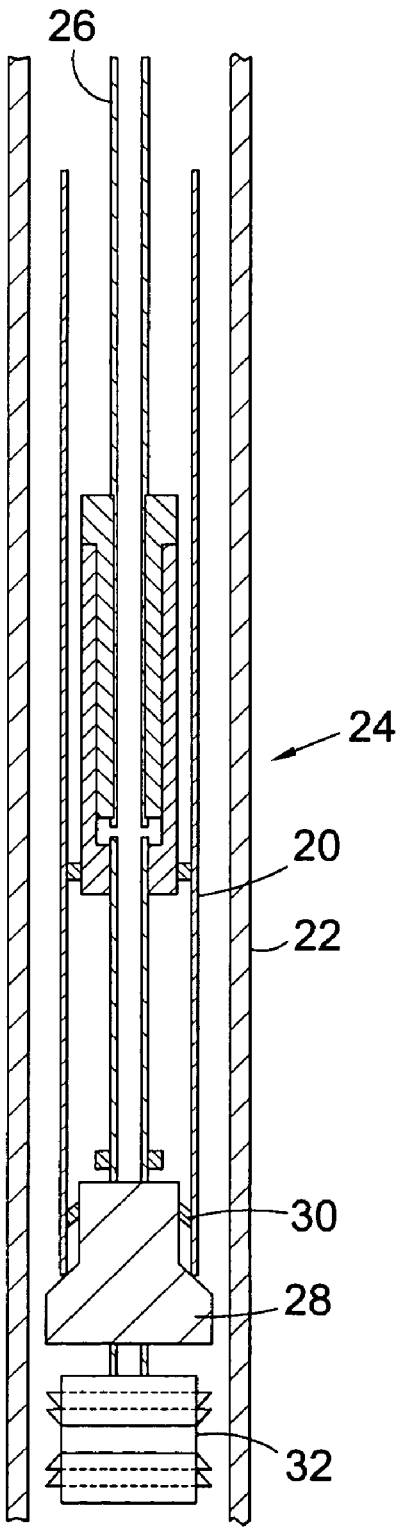
FIGS. 3 to 8 are schematic illustrations of a tubing expansion operation in accordance with a second embodiment of the present invention.

Once the assembly has been run in through the bore 12 to the desired depth, the tubing 14 is anchored in the bore 12, or otherwise anchored or fixed relative to the cone 16, and the cone 16 is pulled through the tubing 14, as illustrated in FIG. 2 of the drawings, to expand the tubing 14 to a larger diameter. The expanded tubing 14 may then be cemented as normal.

Reference is now made to FIGS. 3 through 8 of the drawings which illustrate a tubing expansion operation in accordance with a second embodiment of the present invention.

FIGS. 3 to 8 illustrate the installation of expandable tubing in the form of a patch 20 within an existing bore-lining casing 22, although those of skill in the art will recognise that the invention has utility in many other applications, including expanding tubing in open or unlined bores. The expandable patch 20 forms part of an assembly 24 which is run into the bore on drill pipe 26. The assembly 24 includes an expansion device in the form of a mandrel or cone 28 which is located at the lower end of the patch 20, with the nose of the cone 28 located within the end of the patch 20, but with the larger diameter expansion surfaces of the cone 28 located externally of the patch 20. The cone 28 is mounted on a lower end of the drill pipe 26 and includes a nose seal in the form of a swab cup 30 which engages an inner wall of the patch 20.

A packer 32 is mounted below the cone 28 and, as will be described, is arranged to anchor and seal with an inner surface of the patch 20, following expansion of the lower end of the patch 20.

Figure 4:
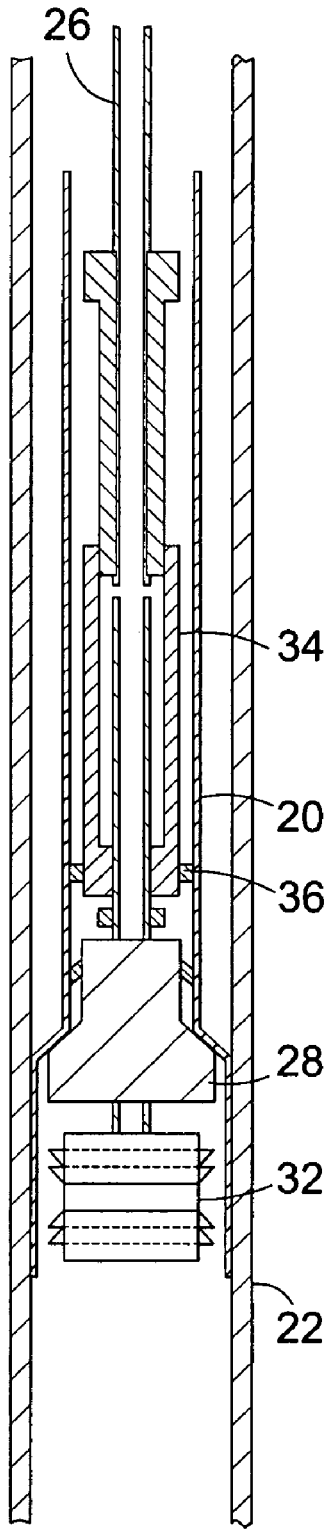

The initial expansion of the patch 20 is achieved by drawing the cone 28 through the lower end of the patch 20, as illustrated in FIG. 4. This initial translation of the cone 28 relative to the patch 28 is achieved by pulling the cone 28 into the patch 20 using a hydraulic jack 34 which is mounted to a portion of the drill pipe 26 above the cone 28, and which is also secured to the patch 20 by a releasable anchor in the form of piston slips 36.

Supply of pressurised hydraulic fluid from surface through the drill pipe 26 to the jack 34 serves to extend the jack 34 and draw the cone 28 through the lower end section of the patch 20, bringing both the cone 28 and the packer 32 into the lower end of the patch 20.

Figure 5:
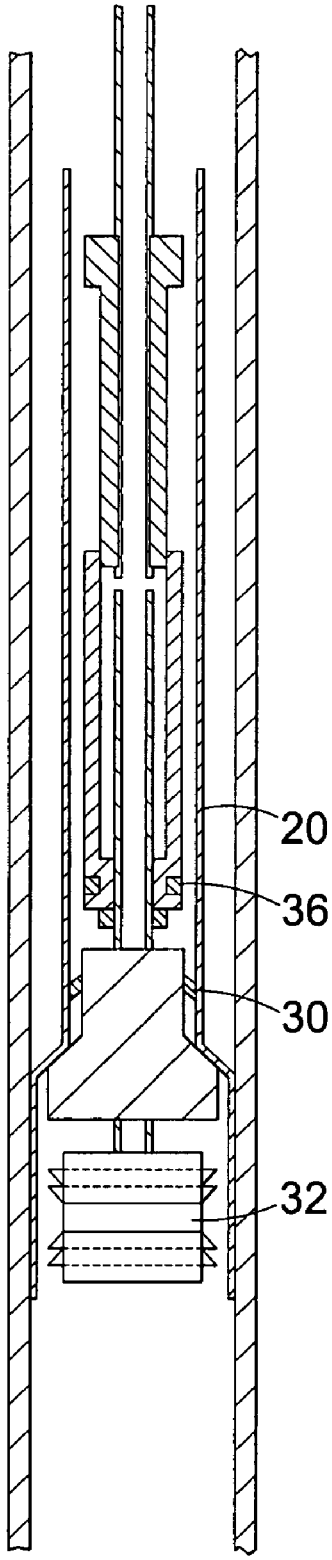
Figure 6:
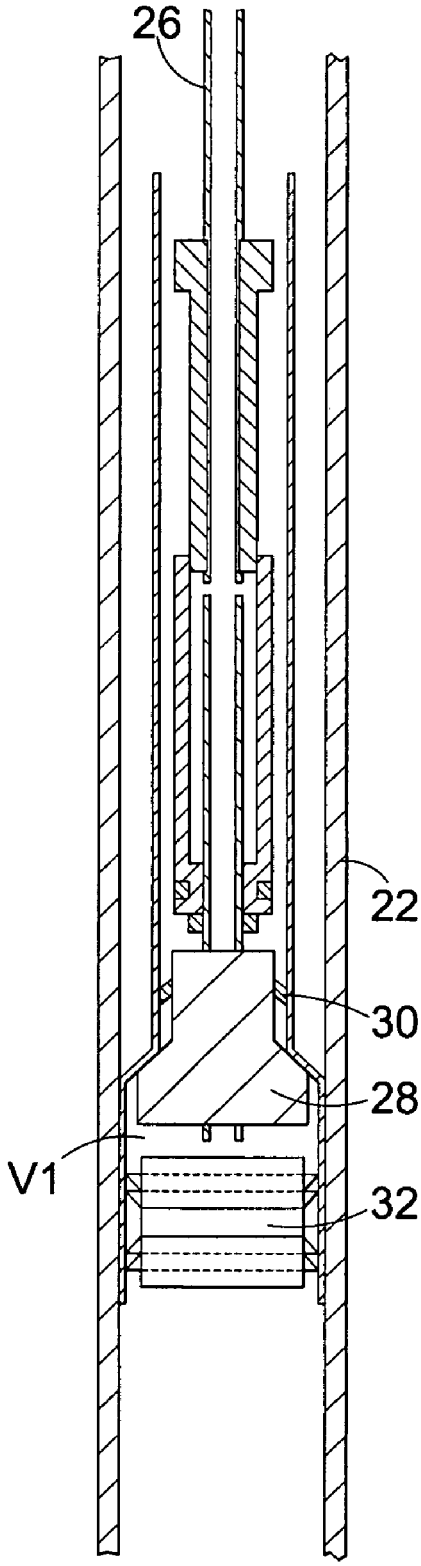

As illustrated in FIG. 5, the jack piston slips 36 are then released, following which the packer 32 is first set within the expanded lower end of the patch 20 and then released from the cone 28, as illustrated in FIG. 6.

The initial expansion of the patch 20 by the cone 28 secures the patch 20 relative to the casing 22, such that tension now may be applied to the cone 28 from surface, or from a tractor or the like, via the drill pipe 26, to pull the cone 28 through the remaining unexpanded length of the patch 20. Furthermore, the volume of fluid V1 between the cone seal 30 and the packer 32 is now isolated from the remainder of the bore, such that pressurising the fluid in the volume V1, via the drill pipe 26, will create a differential pressure across the swab cup 30 and which resulting axial force will translate the cone 28 upwards through the patch 20. The presence of elevated pressure fluid around the cone 28 will also assist in expansion of the patch 20.

Figure 7:
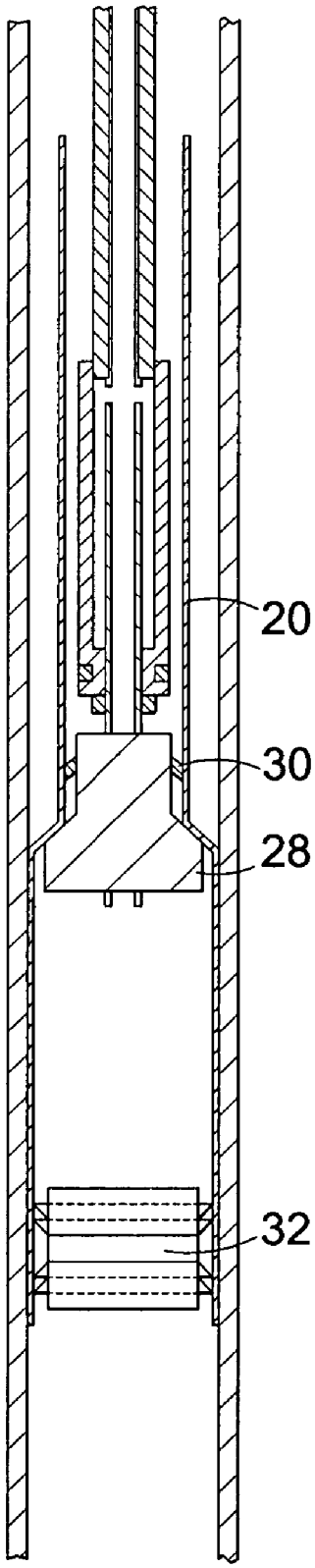
Figure 8:
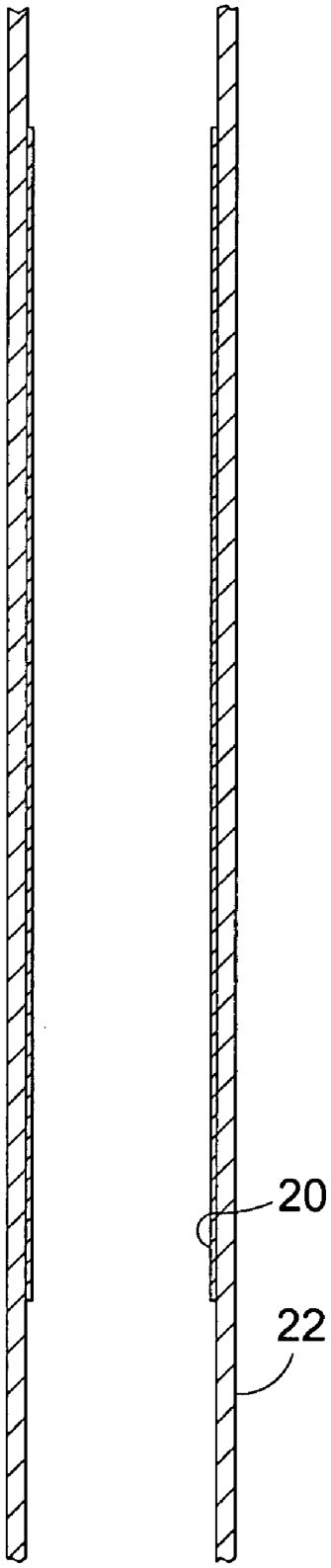

The cone 28 may be translated through the patch 20 in this manner, as illustrated in FIG. 7, until the entire length of patch 20 has been expanded. Following retrieval of the cone 28, the packer 32 may also be retrieved, leaving the patched casing, as illustrated in FIG. 8.

Figure 9:
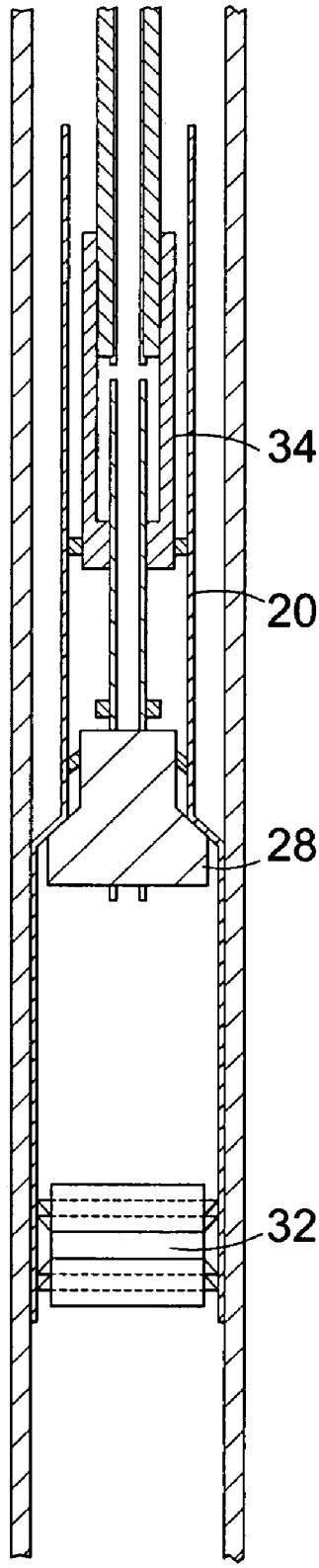
FIGS. 9 and 10 are schematic illustrations of variations to the tubing expansion method of FIGS. 3 to 8.

In an alternative arrangement, as illustrated in FIG. 9 of the drawings, the jack 34 may be utilised to assist in translating the cone 28 through the patch 20, by resetting and then relocating the jack 34 as necessary, as illustrated in FIG. 9. The jack 34 may provide all of the axial force necessary to translate the cone 28, or may be utilised to provide a translating force in addition to that provided by the differential pressure across the cone seal 30; this may be useful if the cone 28 encounters a tight spot or the like.

Figure 10:
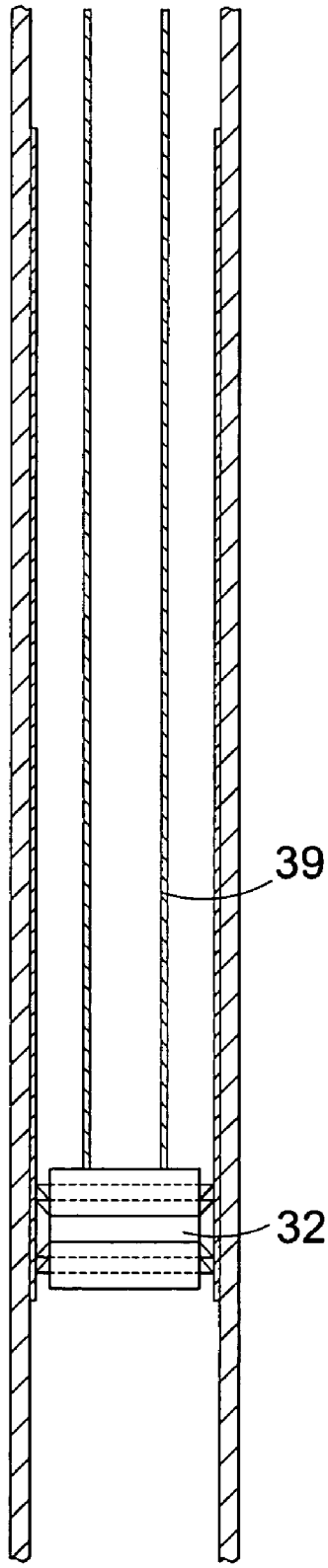

In a further alternative, the packer 32 may remain in the casing 22 and subsequently be used for another purpose, such as a production packer for receiving and locating production tubing 39, as illustrated in FIG. 10 of the drawings.

Figure 11:
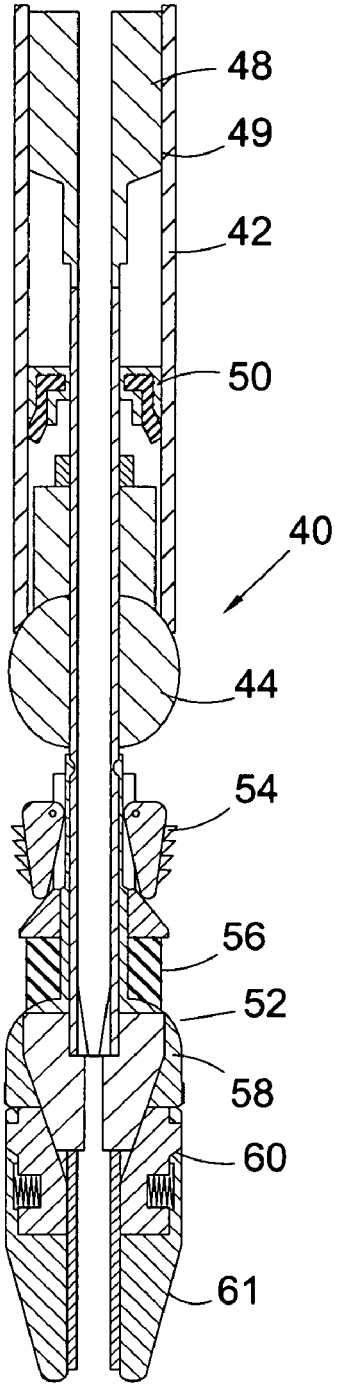
FIGS. 11 to 18 are schematic illustrations of stages in a tubing expansion operation in accordance with a third embodiment of the present invention.

Reference is now made to FIGS. 11 through 18 of the drawings, which illustrate a method of expanding tubing downhole in accordance with a third embodiment of the present invention. This embodiment shares many features with the second embodiment described above, but utilises a somewhat different packer arrangement, as will be described. Reference is first made to FIG. 11, which illustrates the tubing assembly 40 as it is run into a bore, that is the tubing 42 is unexpanded and a primary expansion device 44 is located at the lower end of the tubing 42 with the portion of the device 44 defining a larger diameter expansion surface located outside the tubing 42.

A hydraulic jack 48 with anchor 49 is provided within the tubing 42 above the expansion mandrel 44 and a lead or front pressure seal 50 is provided intermediate the mandrel 44 and the jack 48, the seal 50 being coupled to the mandrel 44.

A packer 52 is provided below the mandrel and includes slips 54 and a seal element 56. Below the packer 52 is a seal cone 58 and casing catchers 60, the casing catchers 60 being provided within a tapered shoe 61.

Figure 12:
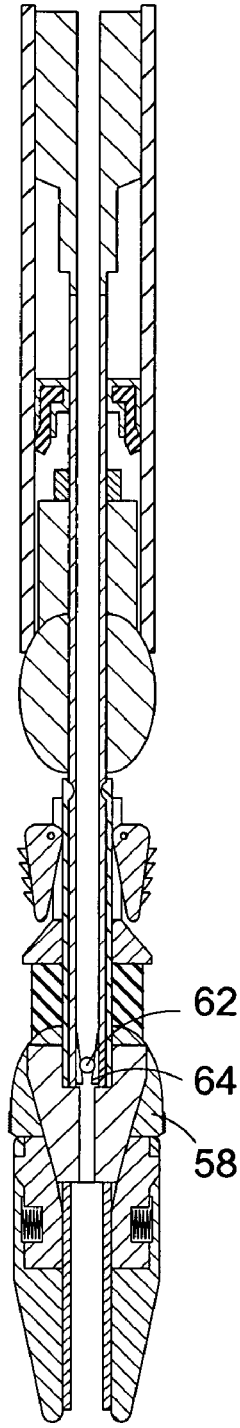

To initiate the expansion process, a dart or ball 62 is dropped from surface through the supporting drill pipe string, the ball 62 being caught by a restriction 64 within the seal cone 58, as illustrated in FIG. 12.

Figure 13:
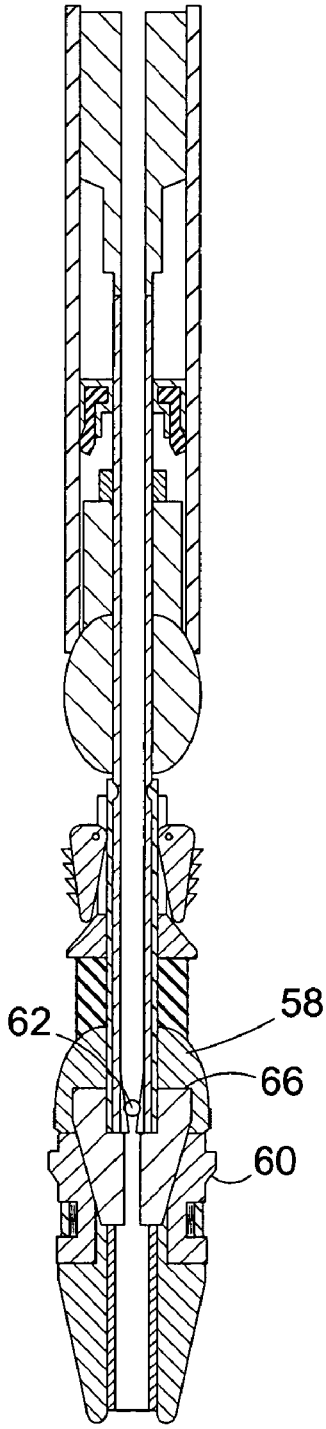

Pressuring above the ball 62 shifts an internal wedge 66 downwards relative to the cone 58 to release the casing catchers 60, which now extend beyond the outer diameter of the seal cone 58, as illustrated in FIG. 13.

Figure 14:
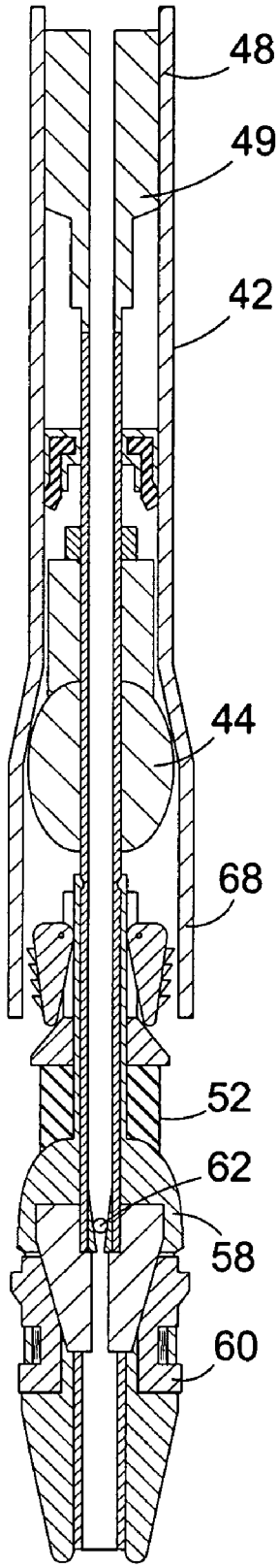
Figure 15:
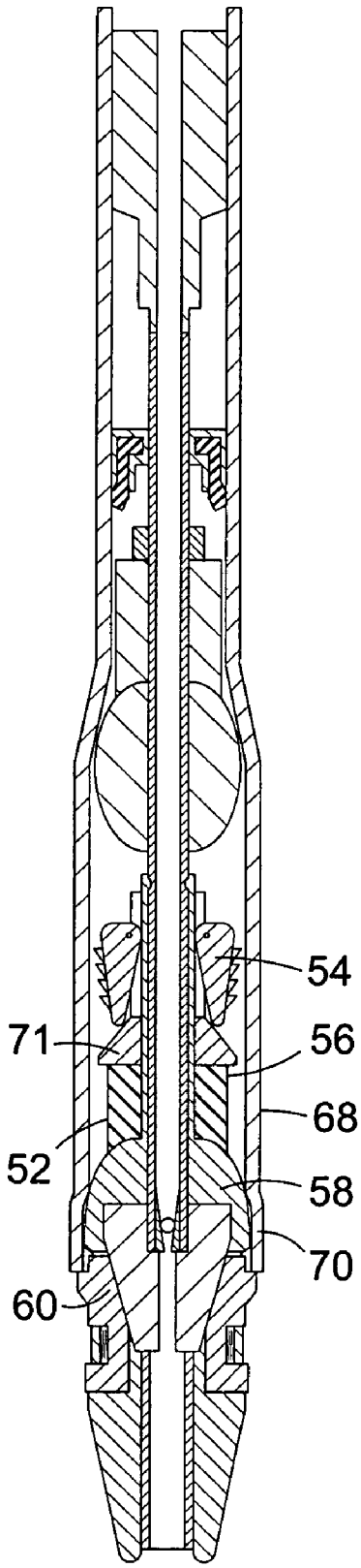

The application of further pressure above the ball 62 causes the anchor 49 to set in the tubing 42 and then actuates the jack 48 to pull the expansion mandrel 44 up through the casing 42 to create an expanded skirt 68, as illustrated in FIG. 14 of the drawings.

The packer 52, seal cone 58 and casing catchers 60 are initially coupled to the expansion mandrel 44 and thus move upwardly into the casing skirt 68 with the mandrel 44.

The seal cone 58 describes an outer diameter which is typically 2% bigger than the internal diameter of the expanded skirt 68, such that on the seal cone 58 moving into the skirt 68 the cone 58 produces an additional 2% expansion, and also creates a fluid-tight sealing contact between the seal cone 58 and the inner wall of the skirt 68. Furthermore, the outer surface of the seal cone 58 may define ratchet teeth 70 which engage with the inner wall of the skirt 68, preventing reverse movement of the cone 58 out of the skirt 68.

Figure 16:
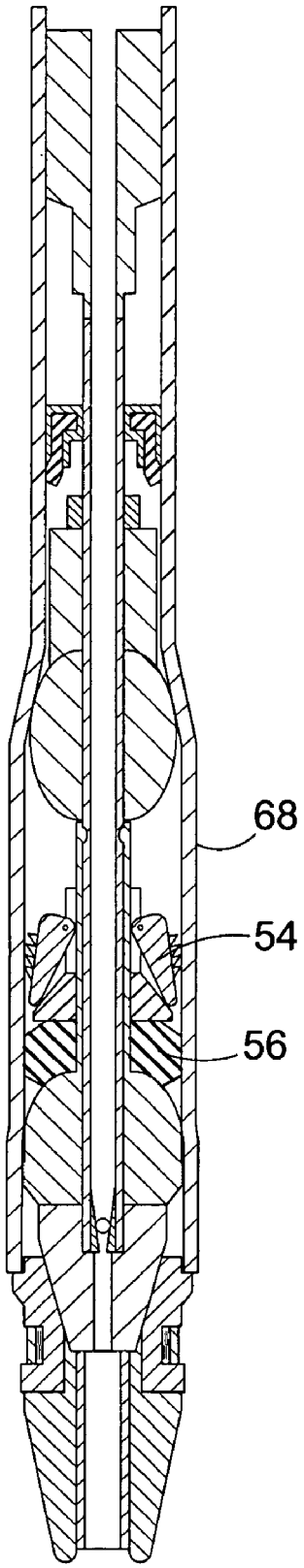

Further movement brings the casing catchers 60 into contact with the end of the skirt 68. The casing catchers 60 are axially coupled to slip activating cones 71 within the packer 52 such that subsequent translation of the expansion mandrel 44 and the seal cone 58 results in relative axial movement between the cones 71 and the slips 54 such that the packer 52 is energised, that is the slips 54 are moved out into engagement with the inner wall of the skirt 68 and the seal element 56 is expanded radially into sealing contact with the inner wall of the skirt 68, as illustrated in FIG. 16.

Figure 17:
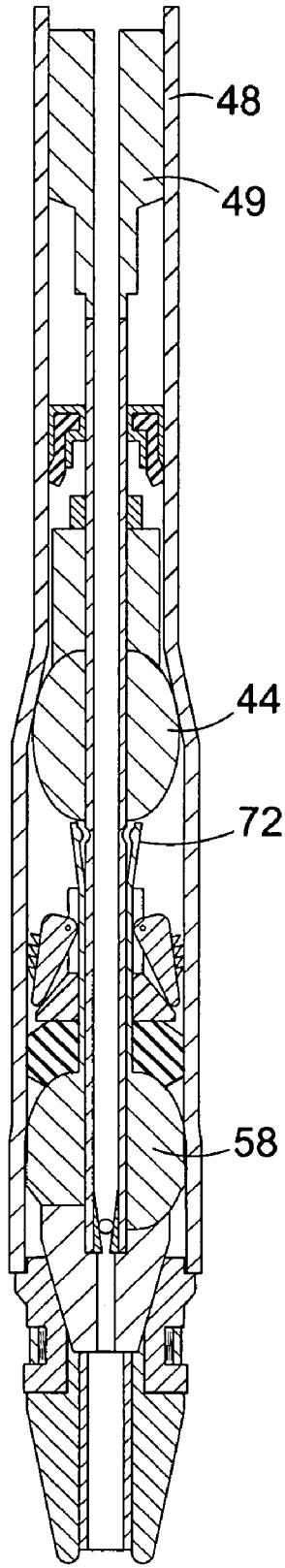

Still further upward movement of the expansion mandrel 44 results in release of dogs 72 which initially provided axial coupling between the mandrel 44 and the seal cone 58, such that following release of the dogs 72 the mandrel 44 and cone 58 may separate, as illustrated in FIG. 17.

Figure 18:
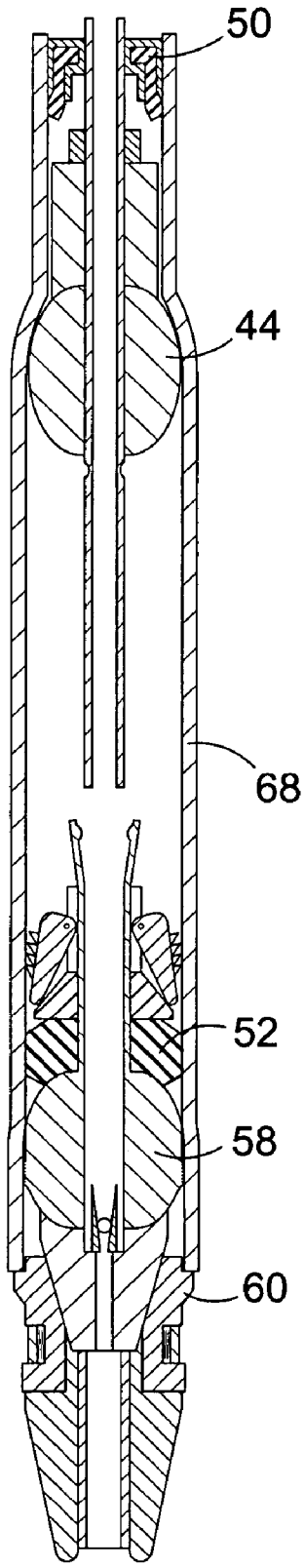

The expansion mandrel 44 continues to move upwardly through the tubing 42 until the jack 48 is fully stroked. At this point the expansion mandrel 44 has been moved free of the packer 52, seal cone 58 and casing catchers 60, as illustrated in FIG. 18, and the jack anchor 49 is released.

As the lower end of the casing 42 is now sealed by the packer 52, the volume of fluid within the skirt 68 between the leading seal 50 and the packer 52 may be pressurised to create a differential pressure across the seal 50 which will tend to translate the expansion mandrel 44 upwardly to expand the remainder of the tubing 42. Alternatively, or in addition, tension may be applied to the mandrel 44 from surface, or a tractor or the like, via the supporting drill pipe, or by moving and resetting the jack 48.

Once the expansion operation has been completed and the expansion mandrel 44 retrieved, the packer 52, seal cone 54 and casing catchers 60 may be drilled out of the expanded casing.

Reference is now made to FIGS. 19 through 25 of the drawings, which illustrate a tubing expansion operation in accordance with a fourth embodiment of the present invention. This embodiment is similar in many respects to the embodiment described above with reference to FIGS. 11 through 18, though it will be noted in the fourth embodiment the packer\seal cone\casing catcher arrangement is somewhat simplified, as will be described.

Figure 19:
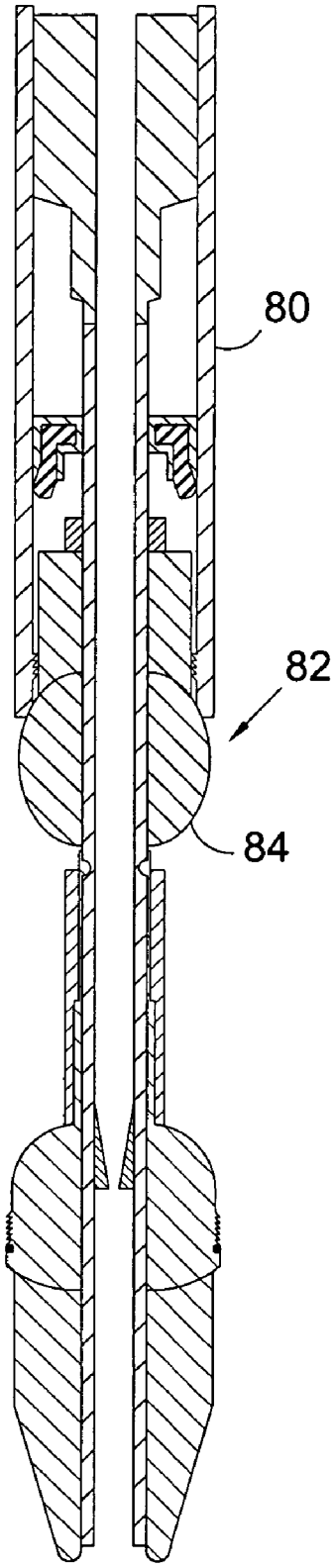
FIGS. 19 to 25 are schematic illustrations of steps of a fourth tubing expansion operation in accordance with a preferred embodiment of the present invention.
Figure 20:
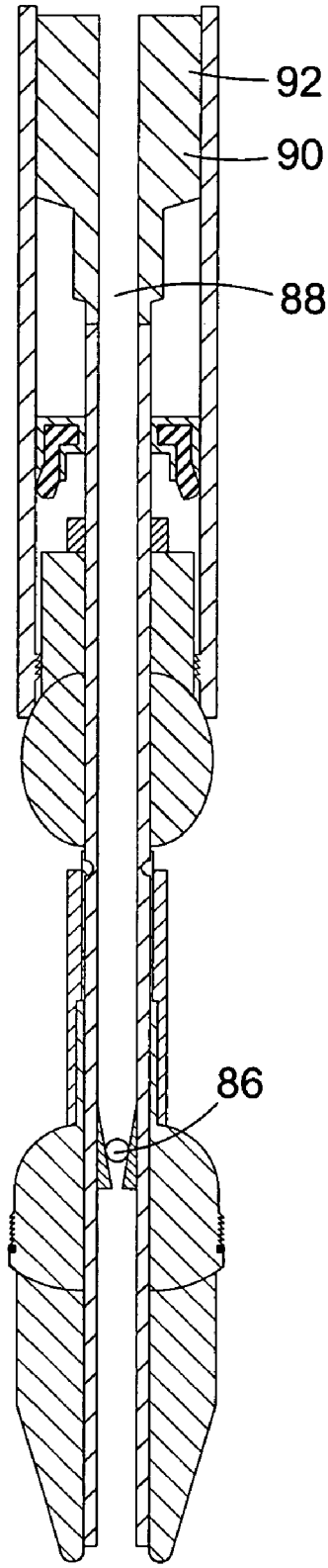
Figure 21:
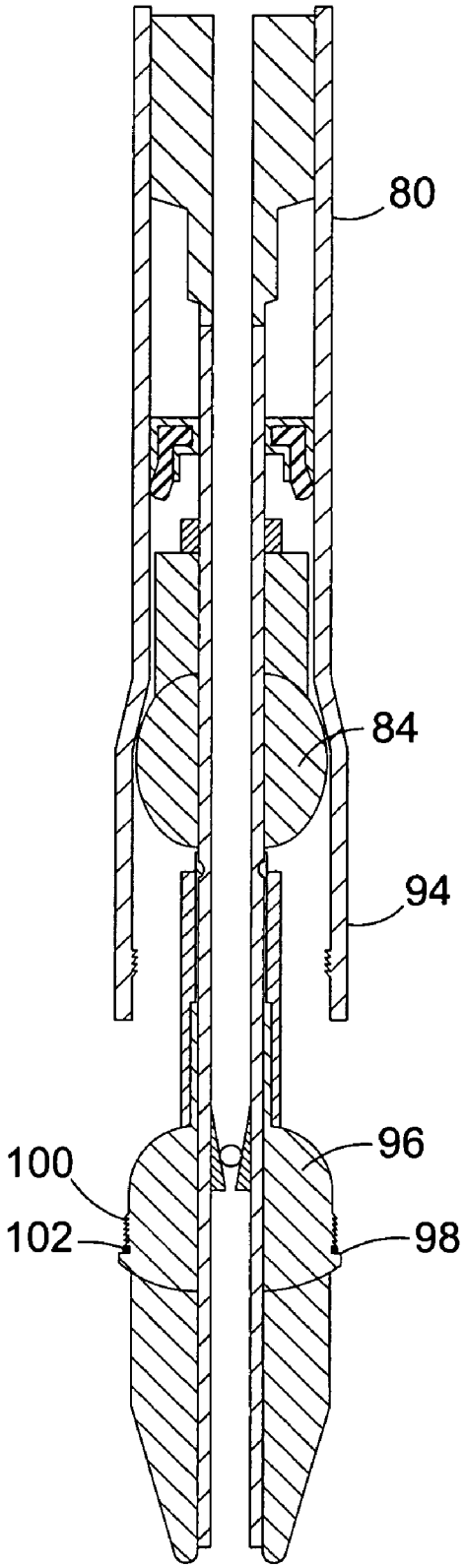
Figure 22:
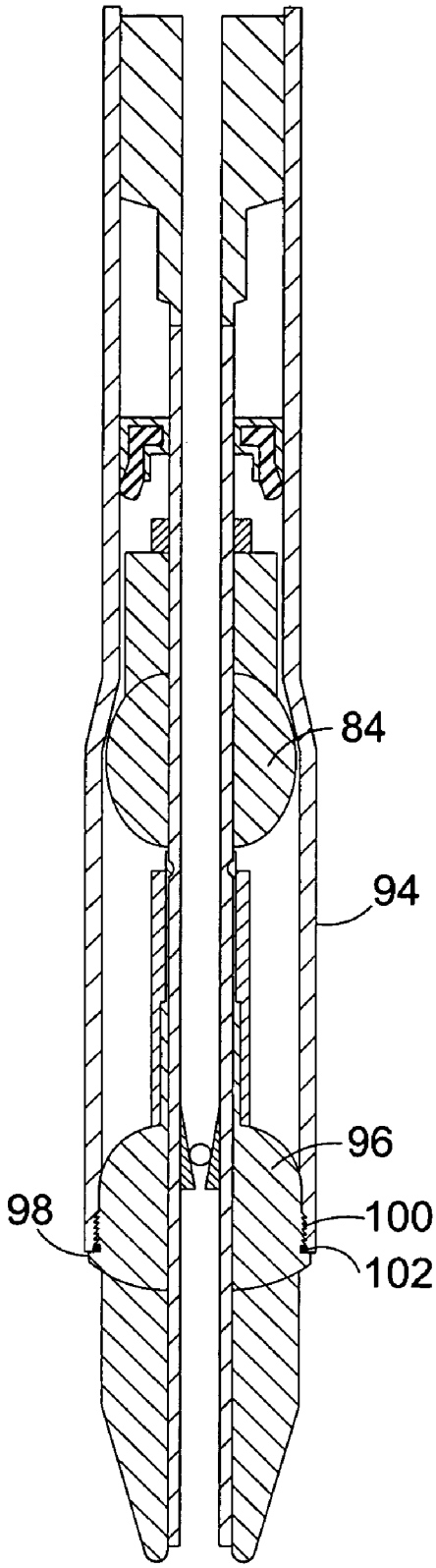

The initial steps in the expansion of the casing 80 are similar to those described above, the casing 80 and the expansion assembly 82 being run into the bore together, with the primary expansion mandrel 84 located beyond the lower end of the casing 80, as illustrated in FIG. 19. A dart 86 is then dropped into the assembly 82 from surface, as illustrated in FIG. 20, allowing the drill pipe bore 88 above the dart 86 to be pressurised to set the anchor 90 and initiate pulling by the jack 92. As illustrated in FIG. 21, this causes the expansion mandrel 84 to be pulled into and through the lower end of the casing 82 to create the expanded skirt 94.

The upwardly moving mandrel 84 carries with it the seal cone 96 which, in this embodiment, incorporates a casing catcher 98 in the form of a shoulder, the outer surface of the seal cone 96 also incorporating ratchet teeth 100 and a seal element 102. As the seal cone 96 moves into the end of the skirt 94, the skirt is expanded by an additional 2%, the seal cone 96 continuing to move into the skirt 94 until the lower end of the skirt 94 engages the shoulder 98.

Figure 23:
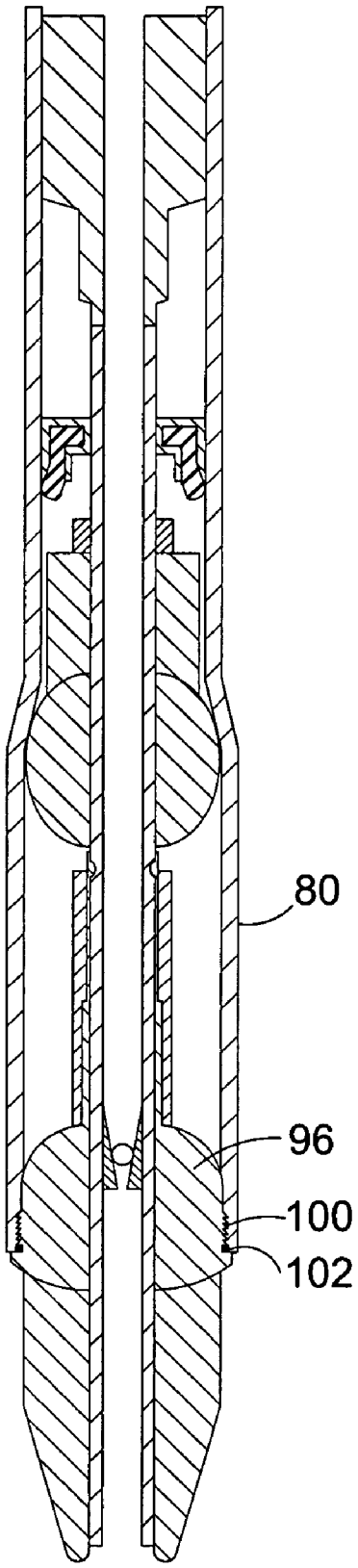

When a tubing is expanded, it has been found that the free end of the tubing tends to diametrically contract relative to the remainder of the tubing, which effect is known to those of skill in the art as "end effects". In this embodiment the end effects are utilised to secure and seal the cone 96 relative to the casing 80 as the tendency for diametric shrinkage at the end of the casing 80 brings the casing into tighter engagement with the ratchet teeth 100 and the seal element 102, securely locating and sealing the seal cone 96 in the end of the casing 80, as illustrated in FIG. 23.

Figure 24:
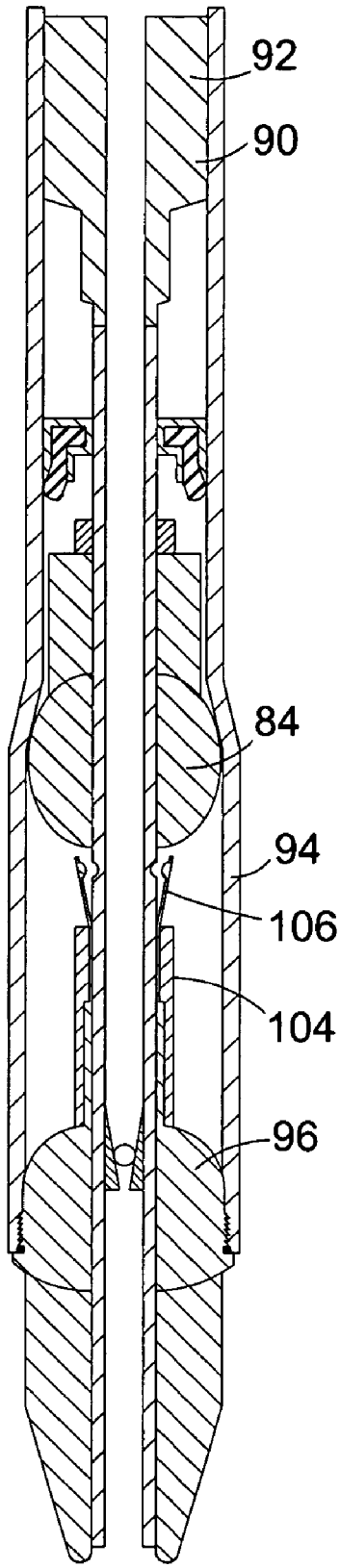
Figure 25:
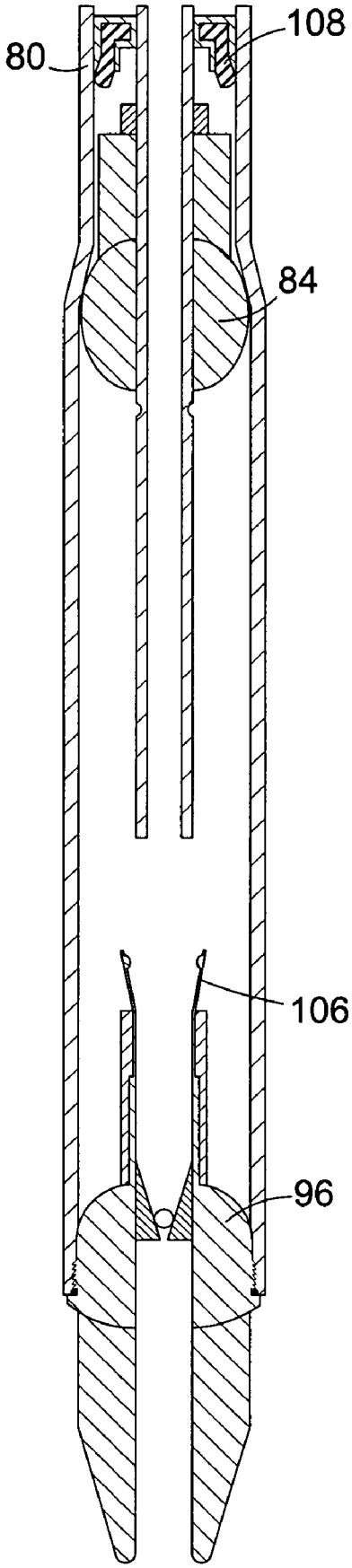

Further upward movement of the mandrel 84 relative to the seal cone 96 results in a support sleeve 104 being pulled down to remove support from dogs 106 coupling the seal cone 96 to the mandrel 84, and permitting separation of the mandrel 84 from the cone 96, as illustrated in FIG. 24.

Actuation of the jack 92 continues until the jack is fully stroked, at which point the anchor 90 is released. As with the third embodiment, the isolated volume of fluid within skirt 94 between the seal cone 96 and the lead seal 108 may now be pressurised to create a differential pressure force across the seal 108 which tends to translate the mandrel 84 upwardly through the casing 80, to expand the remainder of the casing 80.

Figure 26:
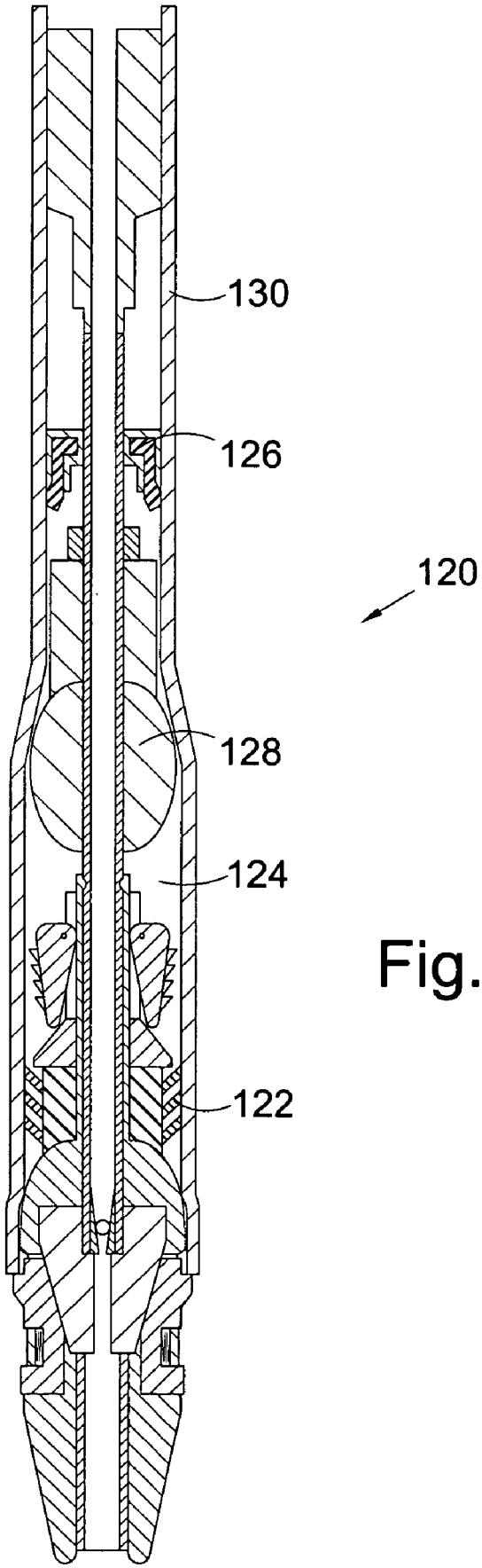
FIG. 26 is a schematic illustration of tubing expansion apparatus in accordance with a further embodiment of the invention.
Figure 27:
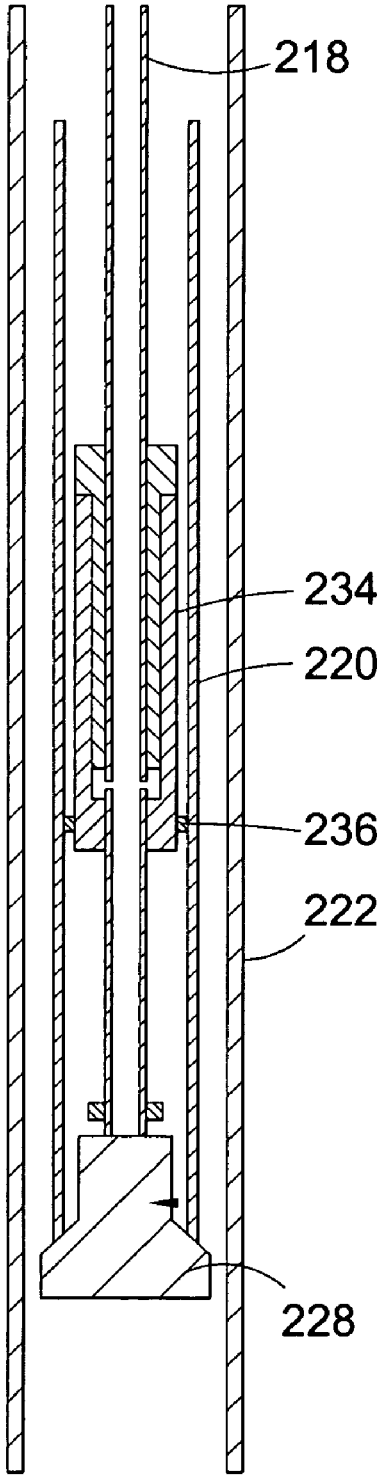
FIGS. 27 to 31 are schematic illustrations of stages in a tubing expansion operation in accordance with a still further embodiment of the invention.
Figure 28:
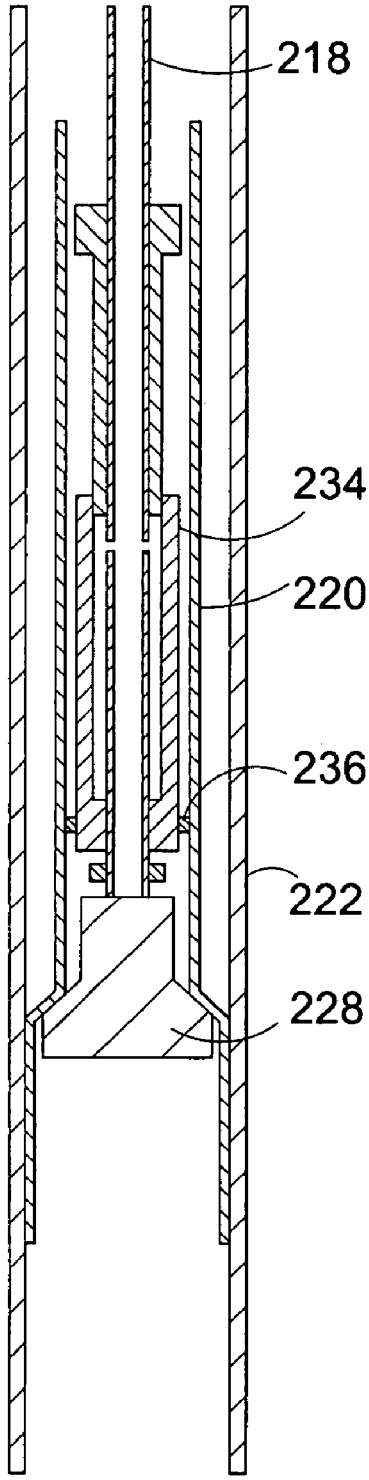

Reference is now made to FIG. 26 of the drawings, which illustrates tubing expansion apparatus in accordance with a further embodiment of the invention. The apparatus 120 is similar to that illustrated in FIGS. 11 to 18, however rather than a radially extendable seal element 56, the apparatus 120 features cups seals in the form of inverted, hollow conical elastomeric elements 122. This form of seal does not rely on elastomer compression in a radial direction, and will provide an increased seal force with increasing expansion pressure when the volume 124 between the seals 122, 126 is pressurised to drive the primary expansion mandrel 128 through the tubing 130.

Turning now to FIGS. 27 to 31, there are shown schematic illustrations of stages in a tubing expansion operation in accordance with a still further embodiment of the present invention.

FIGS. 27 to 30 illustrate the installation of an expandable tubing in the form of a patch 220 within an existing bore-lining casing 222, in a similar fashion to the embodiment illustrated in FIGS. 3 to 8. Indeed, initial expansion of the patch 20 is achieved using a hydraulic jack 234, similar to the jack 34 shown in FIGS. 3 to 8, and the patch 220 is shown following this initial expansion in FIG. 28.

Figure 29:
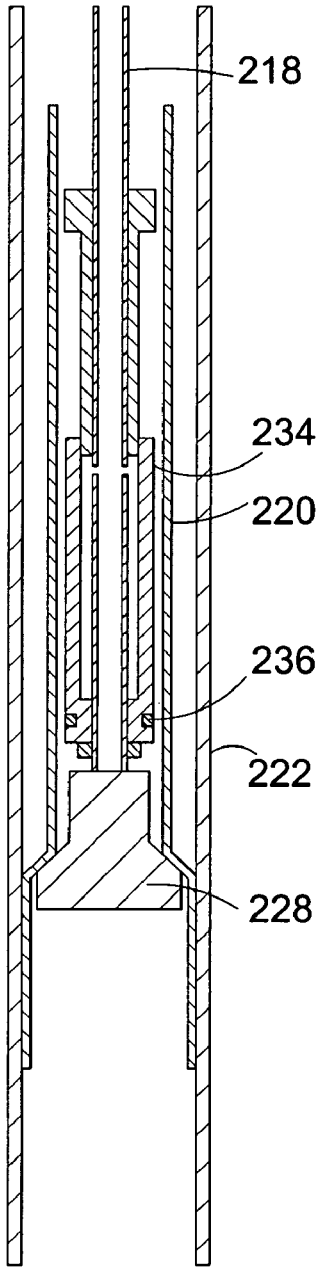
Figure 30:
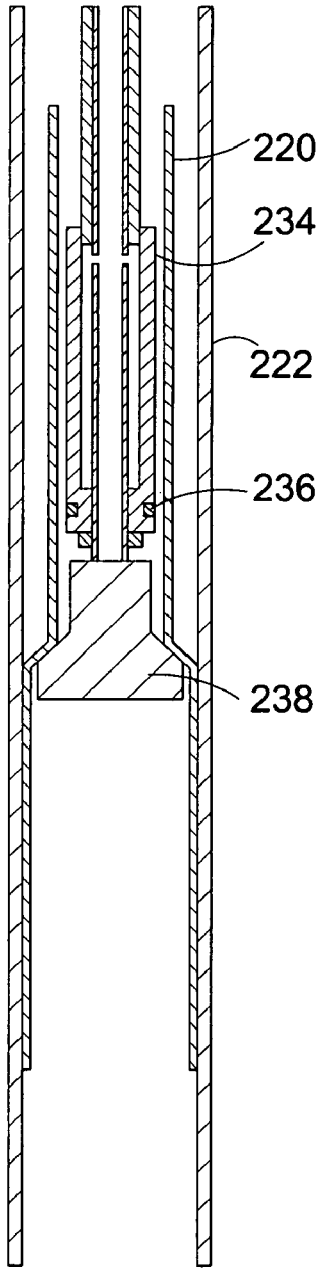
Figure 31:
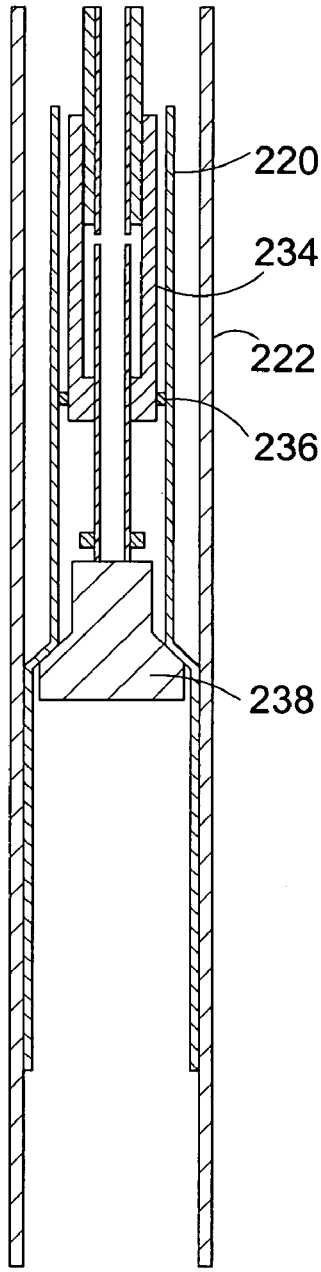

As illustrated in FIG. 29, the jack piston slips 236 are then released. However, in the embodiment of FIGS. 27 to 31, there is no packer such as the packer 32 shown in FIGS. 3 to 8. Further expansion of the patch 220 is then achieved by exerting a direct pull force on the expansion cone 228 through a support string 218 coupled to the cone 228 and which extends to surface, as illustrated in FIG. 30. In a variation, further expansion of the patch 220 is achieved by re-setting the hydraulic jack 234 and subsequently re-actuating the jack 234 to further translate the cone 228 a short distance along the length of the patch 220. The jack 234 is illustrated part way through the process of re-setting in FIG. 31. It will therefore be understood that translation of the expansion cone 228 through the patch 220 may be achieved in a series of short movements, facilitated by the hydraulic jack 234.

It will be apparent to those of skill in the art that the above-described embodiments facilitate location of expandable tubing and the associated expansion apparatus in a bore by allowing an expansion mandrel or cone to be initially located externally of the tubing. The mandrel may then be drawn into the tubing to create a mandrel launcher, and the mandrel launcher then pressurised to translate the mandrel through the tubing, as in a conventional tubing expansion operation. Clearly, as the larger diameter mandrel launcher is created downhole, the diameter of the tubing assembly as run into the bore will be less than a conventional tubing assembly in which the launcher must be created before the assembly is run into the bore.

Those of skill in the art will recognise that the above disclosed embodiments are merely exemplary of the present invention, and that various modifications and improvements may be made thereto, without departing from the scope of the invention. For example, rather than pulling or pushing a cone through an anchored tubing, the tubing may be moved relative to a stationary cone. Furthermore, in alternative embodiments the lower seal cone, such as the cone 96, may be configured to resist rotation relative to the tubing 80, to facilitate drilling out of the cone 96 following completion of the expansion operation. This may be achieved by forming the cone with a non-circular section, for example a hexagonal or octagonal section, which is more likely to resist rotation.

The expansion device may be a collapsible expansion device such as that disclosed in the applicant's UK patent application No. 0304335.3 and European patent publication No. 0862681, the disclosures of which are incorporated herein by way of reference. This may be of a particular utility as apparatus carrying such a collapsible expansion device may be passed down through existing bore restrictions and then moved to an extended configuration to expand the tubing in the borehole.

The trailing seal member, such as the packer 32 in the embodiment of FIG. 3 to 8, or the packer 52, slips 54, seal cone 58 and/or casing catchers 60 of the embodiment illustrated in FIGS. 11 to 18 may be removed following complete expansion of the respective patch 20/casing 42 by dissolving at least part of the respective trailing seal member. This may be achieved by using a chemical pill specially formulated to dissolve a known volume of material, and may avoid the need to drill out the respective trailing seal member. For example, if metal components of the respective trailing seal member are made of a suitable aluminium alloy, potassium hydroxide may be used to dissolve the aluminium alloy. Alternative fluids may be utilised for different alloys or indeed for dissolving elastomeric, rubber or other materials forming part of the respective trailing seal member.

The invention claimed is:

1. A method of expanding tubing comprising:

a. providing an assembly comprising a section of expandable tubing and an expansion device located at least partially externally of the tubing;

b. running the assembly into a bore;

c. translating the expansion device relative to the tubing with a first translation arrangement to advance the expansion device through, and expand, an end section of the tubing disposed ahead of the expansion device prior to the translating; and d. further translating the expansion device relative to the tubing with a second translation arrangement to advance the expansion device through, and expand, a further section at the tubing disposed ahead of the expansion device prior to the further translating.

2. The method of claim 1, comprising:

translating the expansion device in step c by pulling the expansion device from an anchor which is fixed to the tubing.

3. The method of claim 1, comprising:

translating the expansion device in step c by pulling the expansion device from an anchor within the tubing.

4. The method of claim 1, comprising translating the expansion device in step c by pulling the expansion device from an anchor which is fixed relative to the tubing, and then releasing the anchor.

5. The method of claim 1, comprising utilising a fluid actuated tool to apply a force to translate the expansion device in step c.

6. The method of claim 5, comprising utilising a hydraulic jack anchored within the tubing and coupled to the expansion device to translate the expansion device relative to the tubing in step c.

7. The method of claim 5, further comprising utilising said fluid actuated tool to translate the expansion device relative to the tubing in step d.

8. The method of claim 5, wherein the fluid actuated tool is initially fixed relative to the tubing, and subsequently releasing the tool from the tubing.

9. The method of claim 1, comprising translating the expansion device in step d at least in part by exerting a force on the expansion device through a tool string coupled thereto.

10. The method of claim 1, comprising coupling the expansion device to a tool string extending to surface, and translating the expansion device in step d at least in part by translating the tool string relative to the tubing.

11. The method of claim 1, comprising:

translating the expansion device in step d by application of a fluid pressure force thereto.

12. The method of claim 11, comprising translating the expansion device in step d by applying a differential fluid pressure across a leading seal member engaging an inner wall of the tubing.

13. The method of claim 11, comprising, following at least initiation of step c, isolating a volume of fluid within the tubing and pressurising said volume to create a fluid pressure force to translate the expansion device in accordance with step d.

14. The method of claim 11, comprising, following at least initiation of step c, locating a trailing sealing member in said expanded end section of the tubing.

15. The method of claim 14, comprising initially locating the trailing seal member externally of the tubing.

16. The method of claim 14, comprising translating the trailing seal member during step c to engage the seal member with the tubing.

17. The method of claim 16, comprising translating the trailing seal member together with the expansion member during at least a portion of step c.

18. The method of claim 17, comprising releasing the trailing seal member from the expansion member.

19. The method of claim 14, comprising anchoring said trailing seal member relative to the tubing.

20. The method of claim 19, comprising anchoring said trailing seal member to said expanded end section of the tubing.

21. The method of claim 14, comprising further expanding at least a portion of said expanded end section to receive said trailing seal member.

22. The method of claim 21, comprising providing a profile on said trailing seal member to engage with the free end of said further expanded section.

23. The method of claim 14, further comprising removing the trailing seal member from the tubing.

24. The method of claim 23, comprising releasing the seal member from the tubing and then retrieving the seal member from the tubing.

25. The method of claim 14, further comprising maintaining said trailing seal member in the tubing post expansion.

26. The method of claim 25, comprising utilising the trailing seal member as a production packer for receiving and locating production tubing.

27. The method of claim 1, wherein the expansion device is initially located adjacent a lower end of the tubing and the tubing is expanded bottom-up.

28. The method of claim 1, wherein the expansion device is initially located adjacent an upper end of the tubing and the tubing is expanded top-down.

29. A method of expanding tubing, comprising:

a. providing an assembly comprising a section of expandable tubing and an expansion device located at least partially externally of the tubing;

b. running the assembly into a bore;

c. translating the expansion device relative to the tubing to expand an end section of the tubing by pulling the expansion device from an anchor which is fixed relative to the tubing; and d. further translating the expansion device relative to the tubing to expand a further section of the tubing.

30. A method of expanding tubing comprising:

a. providing an assembly comprising a section of expandable tubing and an expansion device located at least partially externally of the tubing;

b. running the assembly into a bore;

c. (i) translating the expansion device relative to the tubing to expand an end section of the tubing;

(II) pressurising at least a portion within the tubing defined by an inside diameter of said end section of the tubing that is expanded to create a fluid pressure force which applies a translating force to the expansion device; and then d. further translating the expansion device under the influence of said translating force relative to the tubing to expand a further section of the tubing.

31. Apparatus for expanding tubing comprising:

an expansion device adapted to be located at least partially externally of tubing to be expanded;

a first translation arrangement adapted for initially translating the expansion device into the tubing to provide an initial expansion; and a second translation arrangement adapted for subsequently translating the expansion device through the tubing by isolating a volume of fluid within the tubing to permit pressurising of said volume to create a fluid pressure force to translate the expansion device.

32. The apparatus of claim 31, further comprising a length of expandable tubing, and wherein the expansion device is located at least partially externally of the tubing.

33. The apparatus of claim 31, wherein the first translation arrangement is adapted to pull the expansion device.

34. The apparatus of claim 31, further comprising an anchor adapted to couple the first translation arrangement relative to the tubing.

35. The apparatus of claim 34, wherein the anchor is adapted to fix the first translation arrangement relative to the tubing.

36. The apparatus of claim 35, wherein the anchor is adapted to fix the first translation arrangement within the tubing.

37. The apparatus of claim 34, wherein the anchor is releasable.

38. The apparatus of claim 31, wherein the first translation arrangement is at least partially mechanically actuated.

39. The apparatus of claim 31, wherein the first translation arrangement is at least partially electrically actuated.

40. The apparatus of claim 31, wherein the first translation arrangement is at least partially fluid actuated.

41. The apparatus of claim 40, wherein the first translation arrangement comprises a hydraulic jack adapted to be anchored within the tubing and coupled to the expansion device to translate the expansion device relative to the tubing.

42. The apparatus of claim 40, whereIn the first translation arrangement is adapted to be initially fixed relative to the tubing and then subsequently released from the tubing.

43. The apparatus of claim 31, wherein the second translation arrangement is adapted to pull the expansion device to at least partly translate the expansion device through the tubing.

44. The apparatus of claim 43, wherein the second translation arrangement includes a tool string coupled to the expansion device, for pulling the expansion device.

45. The apparatus of claim 31, wherein the second translation arrangement is adapted to be fluid pressure actuated.

46. The apparatus of claim 31, wherein the second translation arrangement comprises a trailing seal member adapted for location in an end section of the tubing.

47. The apparatus of claim 46, wherein the trailing seal member is adapted to be initially located externally of the tubing.

48. The apparatus of claim 47, wherein the trailing seal member is adapted to be translated to engage, with the tubing.

49. The apparatus of claim 48, wherein the trailing seal member is adapted to be translated by the first translation arrangement.

50. The apparatus of claim 49, wherein the trailing seal member is releasable from the expansion member.

51. The apparatus of claim 46, wherein the trailing seal comprises at least one cup seal.

52. The apparatus of claim 46, wherein said trailing seal member comprises an anchor for retaining the member relative to the tubing.

53. The apparatus of claim 52, wherein the anchor is adapted to couple the trailing seal member to an expanded end section of the tubing.

54. The apparatus of claim 53, comprising a further expansion device adapted for further expanding at least a portion of an end section of the tubing to receive said trailing seal member.

55. The apparatus of claim 46, wherein said trailing seal member defines a profile for engaging with a free end of the expanded tubing.

56. The apparatus of claim 46, wherein the trailing seal member is adapted to be removable from the tubing.

57. The apparatus of claim 56, wherein the trailing seal member is drillable.

58. The apparatus of claim 57, wherein the trailing member is adapted to resist rotation relative to the tubing.

59. The apparatus of claim 58, wherein the trailing seal member comprises a portion having a non-circular profile for engaging with the tubing.

60. The apparatus of claim 56, wherein the trailing seal member is retrievable.

61. The apparatus of claim 46, wherein the trailing seal member Is adapted to be maintained in the tubing post expansion.

62. The apparatus of claim 61, wherein the trailing seal member comprises a production packer for receiving and locating production tubing.

63. The apparatus of claim 31, wherein the expansion device is adapted to be initially located adjacent a lower end of the tubing.

64. The apparatus of claim 31, wherein the expansion device is adapted to be initially located adjacent an upper end of the tubing.

65. The apparatus of claim 31, further comprising a housing for the expansion device.

66. The apparatus of claim 65, wherein the housing is adapted to be separable from the expansion device.

67. The apparatus of claim 65, wherein the housing is deformable.

68. The apparatus of claim 65, wherein the housing is frangible.

69. The apparatus of claim 31, wherein the expansion device comprises a cone or mandrel.

70. Apparatus for expanding tubing downhole, the apparatus comprising:

an expansion device adapted to be translated through tubing to expand the tubing to a larger diameter;

a first translation arrangement adapted for translating the expansion device into the tubing to expand at least an end portion of the tubing, wherein the first translation arranagment is adapted to be initially fixed relative to the tubing and then subsequently released from the tubing; and a second translation arrangement adapted for translating the expansion device through a further portion of the tubing.

71. Apparatus for expanding tubing comprising:

an expansion device;

a first translating arrangement adapted for initially translating the expansion device through tubing to be expanded to provide an initial expansion;

a second translating arrangement adapted for subsequently translating the expansion device through the tubing; and an anchor adapted to couple the first translation arrangement relative to the tubing.

* * * * *